US006019042A

United States Patent [19]

Batti et al.

[11] Patent Number: 6,019,042

[45] Date of Patent: Feb. 1, 2000

[54] PRINTING BLANKET FOR OFFSET PRINTING

[75] Inventors: Giovanni Batti, Tione di Trento; Bruno Ginelli, Lodi; Mirco Pellegrini, Tione de Trento, all of Italy

[73] Assignee: Novurania, S.p.A., Tione di Trento, Italy

[21] Appl. No.: 08/976,069

[22] Filed: Nov. 21, 1997

[30] Foreign Application Priority Data

Nov. 22, 1996 [DE] Germany ..... 196 48 494

[51] Int. Cl.[7] ..... B41N 10/02

[52] U.S. Cl. ..... 101/376; 428/909

[58] Field of Search ..... 101/217, 375, 101/376; 428/909

[56] References Cited

U.S. PATENT DOCUMENTS

| | | | |
|---|---|---|---|
| 2,792,322 | 5/1957 | Fredericks | 428/909 |
| 3,263,606 | 8/1966 | Poynter | 101/179 |
| 3,881,045 | 4/1975 | Strunk | 428/909 |
| 3,983,287 | 9/1976 | Goossen et al. | 428/909 |
| 4,981,750 | 1/1991 | Murphy et al. | 428/909 |
| 5,006,400 | 4/1991 | Pinkston et al. | 428/909 |
| 5,066,537 | 11/1991 | O'Rell et al. | 428/909 |
| 5,116,669 | 5/1992 | Sonobe | 428/909 |
| 5,264,289 | 11/1993 | Kondo et al. | 101/401 |
| 5,323,702 | 6/1994 | Vrotacoe et al. | 101/376 |
| 5,352,507 | 10/1994 | Bresson et al. | 428/909 |

FOREIGN PATENT DOCUMENTS

| | | |
|---|---|---|
| 0 676 301 | 10/1995 | European Pat. Off. . |
| 19 40 852 | 2/1970 | Germany . |
| 22 44 766 | 3/1974 | Germany . |
| 59-209198 | 11/1984 | Japan . |
| 3-133695 | 6/1991 | Japan . |
| 1250912 | 10/1971 | United Kingdom . |

OTHER PUBLICATIONS

Patent Abstracts of Japan, JP 59 209198, vol. 009, No. 080 (M–370), Nov. 27, 1984.

*Primary Examiner*—Stephen R. Funk
*Attorney, Agent, or Firm*—Scully, Scott, Murphy & Presser

[57] ABSTRACT

An offset printing blanket produced from a continuous roll or web, with a lithographic surface, a compressible layer, at least one reinforcing layer with low stretch characteristics, and a fabric layer located on the side of the reinforcing layer which is opposite to the lithographic surface. The compressible layer is located between the lithographic surface and the reinforcing layer.

7 Claims, 2 Drawing Sheets

PRINTING BLANKET FOR OFFSET PRINTING

BACKGROUND OF THE INVENTION

1. Field of the Invention

The invention relates to a printing blanket for offset printing with a lithographic surface, a compressible layer, a reinforcing layer possessing low stretch characteristics, and a fabric layer on the side of the reinforcing layer, which is opposite to the lithographic printing surface.

Printing blankets which are affixed to the blanket cylinder of an offset printing machine are designed to transfer the image to be printed, normally carried on a metal printing plate, onto the material which is to be printed, normally paper, board or metal, which may be in the form of sheets or rolls. Essentially, there are three known types of printing blankets. The first type, to which the present invention is related, are so-called continuously manufactured printing blankets, which are produced continuously in the form of a roll and then cut to size according to the dimensions of the blanket cylinder upon which they are to be installed. The second and third types are individually manufactured printing blankets which are both specially produced for the blanket cylinder upon which they are to be installed and, in one case, can be slid onto the blanket cylinder like a sleeve ("sleeve printing blanket") or in the other case can be individually stretched into position using a tensioning mechanism. The second type of printing blanket has the advantage that, unlike traditional printing blankets, it does not have to be secured by means of a gap cut into the surface of the blanket cylinder (gapless cylinder). Thus, no eccentric movements are generated during rotation of the blanket cylinder and, as a result, faster revolutions and thus printing speeds are possible. However, the disadvantage of such sleeve-type printing blankets is that the printing press has to be specially designed to accommodate them and, as a consequence, is extremely expensive: the sleeve blankets themselves are also very expensive compared to existing blankets.

As mentioned above, continuously manufactured printing blankets are cut to size according to the dimensions of the blanket cylinder. In the past, mounting bars were attached to the blanket, normally by means of bolts, in order to secure it in place on the blanket cylinder. This technique is, however, obsolescent and, nowadays, disposable bars are used which are fixed onto the blanket by the simultaneous use of a press and adhesive. Once the blanket is worn out it is discarded, along with the disposable bars. Compared to the previously employed re-usable mounting bars, it is therefore important, in the case of the modern technique, that the blanket construction is such as to ensure problem-free adhesion of the disposable bars to the blanket.

2. Discussion of the Prior Art

The Japanese Patent Application No. 58-84294, Patents Abstracts of Japan, 1985 Vol. 9/No.80, describes a blanket with a lithographic surface on its topside and a metal layer on the underside. There is a compressible layer located between the metal layer and the lithographic surface. A compressible layer of this kind serves to avoid distortion caused by volume reduction in the image area and also to compensate for variations in indentation. It is an essential characteristic of the compressible layer that it does not expand laterally when compressed, i.e. that its volume actually reduces, so that no lateral distortion occurs. There are several known ways of achieving this, such as, for example the use of plastic micro-spheres suspended in a rubber compound, or the use of a microporous cellular structure with enclosed gas voids. The printing blanket described in the Japanese patent application has the great disadvantage that the underside consists of the reinforcing ply which in this case is made of metal and thus the disposable fixing bars commonly used these days to secure the blanket to the blanket cylinder cannot be reliably bonded to it. The disposable mounting bars which are made from a metal such as aluminum are difficult to bond to the metal layer and thus a safe and reliable tensioning of the blanket onto the blanket cylinder is not possible. A further disadvantage of the metal layer on the underside of the printing blanket is that the moisture which forms between the printing blanket and the blanket cylinder during the printing process, or which finds its way in there, is neither absorbed by the printing blanket nor able to find its way out laterally between printing blanket and the blanket cylinder, thus potentially causing corrosion. The same disadvantages are applicable to blankets which have on their underside a polymer or polyester film, as the disposable bars cannot easily be bonded to these materials and they also absorb no moisture.

Certain of the known printing blankets without a reinforcing layer have the disadvantage that the stabilizing layer (or several stabilizing layers) which is (are) made of woven material, typically cotton fabric, exhibits a relatively high degree of stretch. As a result, the blankets require frequent retensioning on the blanket cylinder and the print quality is adversely affected by a blurring of the individual dots. Especially in four color applications, where for the application of four colors, four successively arranged blanket cylinders are used, uneven stretching of the four successively positioned printing blankets used to print the same sheet of paper, can lead to a mis-register of the colors and thereby to a loss of image sharpness.

Furthermore, in the case of some traditional printing blankets, the stretch in the weft direction is considerably higher than that in the warp direction so that they can only be installed on the blanket cylinder with the warp direction (lengthwise) running around the cylinder. Installation of the printing blankets on the blanket cylinder in the weft direction (widthwise) is not possible, owing to the high degree of stretch.

The Japanese patent application No. 64-273158, Patents Abstracts of Japan, 1991, Vol 15/No.339 describes a blanket with a lithographic surface, a metal reinforcing layer, a compressible layer and a fabric layer which forms the underside of the printing blanket. The fabric layer on the underside of the blanket is located at the underside of the compressible layer which is bonded to the reinforcing layer on its upper side. The printing layer with the lithographic surface is attached to the metal layer by means of an undercoat or adhesive layer. The disposable bars used nowadays can, it should be said, be firmly attached to this blanket, as its underside consists of a fabric layer. However, it exhibits other serious disadvantages. The first disadvantage is that the metal reinforcing layer, consistent with its purpose of avoiding stretching of the blanket in the length or cross direction, exhibits a very low degree of stretch which, when the blanket is tensioned on the blanket cylinder, results in excessive compression of the underlying compressible layer.

This results from the fact that, during manufacture, the individual layers of the blanket are laminated together as flat surfaces, whereas during the printing process the blanket is installed upon the blanket cylinder in the form of a part-circle. As the compressible layer is situated beneath the metal reinforcing layer, it has a shorter radius than the metal layer. Consequently, when the blanket is tensioned, owing to the low stretch characteristics of the metal layer, the compressible layer is compressed and is thus unable or severely limited in its ability to fulfill its intended purpose during the printing process, namely the avoidance of distortion and compensation for variations in indentation, which renders it useless.

Furthermore, owing to the gauge loss of this blanket, only limited printing is possible, since, for instance in the case of blanket to blanket web offset printing, no adjustment is possible.

A further disadvantage of the type of printing blanket described is the fact that it cannot be used for varnishing purposes. In varnishing applications, areas of the printing surface are as a rule cut out (stripped) - either by hand or with the aid of a CAD machine—which correspond to those areas of the printing substrate which are not to be varnished. The remaining unstripped areas of the lithographic surface take up the varnish and print it onto the corresponding areas of the printing substrate which are to be varnished. The quality of the varnish applied and in particular also the life of the printing blanket employed are determined by the depth of the cut-outs. The deeper the cut-out, the easier it is to avoid the accumulation of varnish in the stripped areas which can then be transferred to the printed item (substrate), leading to reduced quality and consequent machine downtime. In the case of the blanket described in the above Japanese patent application, however, the metal layer is located directly beneath the blanket face layer which forms the lithographic surface. If used for varnishing therefore, the maximum depth of the cut-out cut into the face can only be equivalent to the thickness of the face, since it is only possible to cut out to the hard metallic layer. The blanket described is thus poorly suited to use for varnishing applications, since the depth of the cut out is limited by the face thickness and is thus too small.

The cut out areas of the blanket are too shallow and, even after a short print-run, this leads to an accumulation of varnish in the stripped out areas. The blanket described here is therefore unsuitable for varnishing work over extended periods.

SUMMARY OF THE INVENTION

The object of the present invention is therefore to make available a continuously manufactured offset printing blanket with a lithographic surface, a compressible layer, a reinforcing layer with low stretch characteristics and a fabric layer on the side of the reinforcing layer which is opposite to the lithographic surface, which permits improved print quality through better pressure distribution during the printing process and, furthermore, is suitable for varnishing applications. This objective is achieved by means of a continuous produced offset printing blanket, which is characterized by having the compressible layer between the lithographic surface and the reinforcing layer.

Locating the compressible layer between the lithographic surface and the reinforcing layer ensures that the compressible layer is not compressed after tensioning the blanket during installation on the blanket cylinder, that there is no resultant gauge loss which could affect print quality and that maximum compensation is maintained eliminating the effects of variations in indentation. When using a blanket, as defined by this invention, for varnishing applications, the maximum cut-out depth is possible, due to the fact that the compressible layer is located between the reinforcing layer and the lithographic surface. Since, ideally, the cutting out/stripping removes all material down to the hard reinforcing layer, in the case of the blanket defined by this invention, the entire thickness of the printing surface and the entire thickness of the compressible layer along with, where applicable, any intermediate fabric layers can be stripped back so that relatively deep cut-outs of the required depth are formed, thus allowing the accumulation of varnish to be avoided. In this way, the useful life of the blanket for varnishing purposes is considerably prolonged and, in addition, the quality of the varnishing is improved.

The fabric layer, which is located on the side of the reinforcing layer, which is opposite to the lithographic surface, permits safe and reliable securing of the disposable bar systems to the blanket. The disposable bars, which are as a rule made of metal, can be bonded to the fabric without any problems. A further advantage of this fabric layer is the fact that it absorbs any moisture which may build up between the blanket cylinder and the reinforcing layer of the blanket during the printing process and thus, by means of a wicking effect, carries away the moisture so that it evaporates without any adverse corrosive effects on the metal blanket cylinders of the press.

It is advantageous if the fabric layer is located on that side of the reinforcing layer which faces away from the lithographic printing surface. This ensures that the reinforcing layer, which is intended to prevent stretching of the blanket, offers maximum benefit, since it is only separated from the blanket cylinder by a single fabric layer, and also that the blanket can be easily and safely mounted on the blanket cylinder, since no additional layers are being compressed between the reinforcing layer and the blanket cylinder during the tensioning of the blanket.

It can furthermore be an advantage to have at least one additional compressible layer between the lithographic surface and the reinforcing layer. In this way, for example, one or more fabric layers can be incorporated between the first and second compressible layers. Furthermore, it can be an advantage to have at least one additional reinforcing layer between the fabric layer located on that side of the reinforcing layer facing away from the lithographic surface (i.e. the backing fabric) and the reinforcing layer itself. Equally, it is also possible to have the first reinforcing layer and a second reinforcing layer separated by one or more fabric layers.

Furthermore, it is advantageous if the reinforcing layer(s) consist(s) of polymer, polyester or metallic foil. It is particularly advantageous when using the blanket defined by this invention for varnishing applications if, when stripping back cut-out areas, these can be cut down to the hard reinforcing film without inflicting any damage thereto.

BRIEF DESCRIPTION OF THE DRAWINGS

In the following, embodiments of the blanket according to the invention are described which illustrates schematically this type of blanket in cross-section.

DETAILED DESCRIPTION OF PREFERRED EMBODIMENTS

Figure 1:
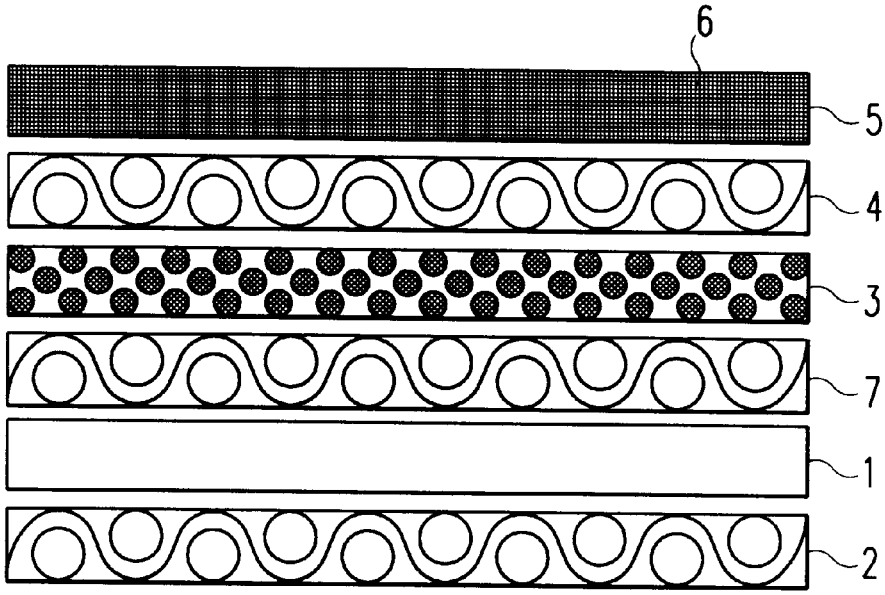
FIG. 1 illustrates a first embodiment of the blanket pursuant to the invention, shown in cross-section.

The blanket of the embodiment exhibits a lithographic layer 5 which possesses a printing surface 6. Beneath the lithographic layer 5 is an intermediate fabric layer 4 and compressible layer 3 which typically contains microspheres.

Beneath this, after a further intermediate fabric layer 7, is the stabilizing layer 1, consisting typically of a polymeric or metallic foil. Beneath this, there is yet another textile backing fabric 2 which serves to ensure the necessary adhesion of the blanket to disposable bar systems which secure the blanket to the blanket cylinder. The layers are bonded to one another using known adhesive technology. It should be mentioned that the textile layers 4 and 7 are included in order to simplify the manufacturing process, though they may be left out without departing from the scope of the invention.

Figure 2:
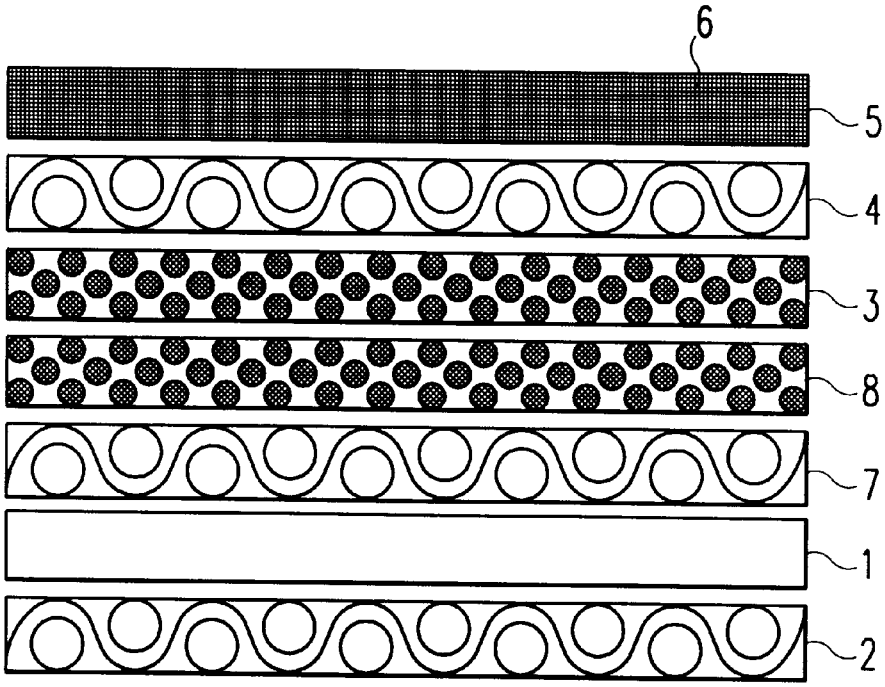
FIG. 2 illustrates a second embodiment of the blanket.

Referring to the embodiment of the invention as shown in FIG. 2 of the drawings, in which layers as shown in the embodiment of FIG. 1 are identified with the same numerals; in this instance, an additional compressible layer 8 is interposed between the lithographic surface 5 and the reinforcing or stabilizing layer 1. Although as shown, the additional compressible layer 8 is located adjacent compressible layer 3, it is also possible to interpose one or more fabric layers 7 between the compressible layers 3 and 8.

Figure 3:
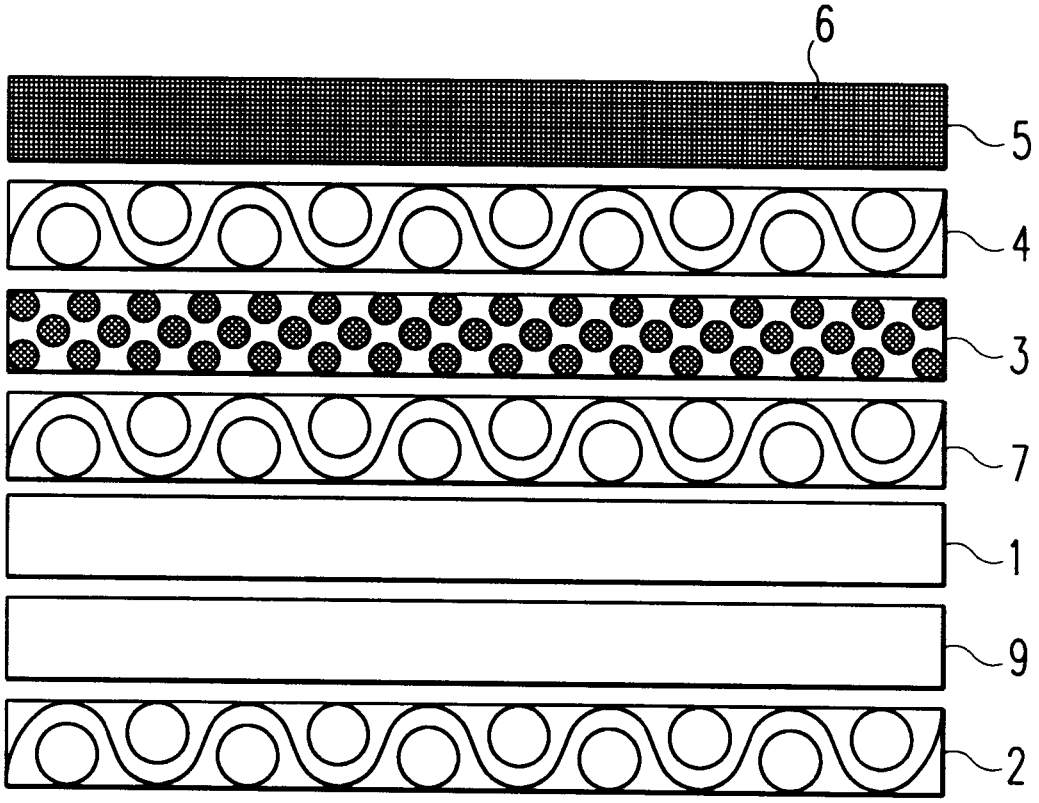
FIG. 3 illustrates a third embodiment of the blanket.

Moreover, as shown in FIG. 3, pursuant to a modified embodiment, in comparison with that of FIG. 1, there may be interposed a second reinforcing layer 9 between the first reinforcing layer 1 and the textile backing fabric 2. Also in this instance can the reinforcing layers 1 and 9 be separated by one or more interposed fabric layers 7.

The static extension of the blanket was measured as follows: a blanket sample measuring 25 mm wide by 300 mm long is mounted on the apparatus and placed under tension of 250 N for a period of 10 minutes. The relative extension of the blanket is measured over a reference length of 100 mm.

In a further embodiment of the invention, the construction of the reinforcing layer is such that the extension of the blanket, when subjected to a static load of 10 Newtons per mm for a period of 10 minutes in both the length and cross directions, is no greater than 3%. The blanket construction advantageously can be modified in such a way to ensure that the static extension in length and cross direction is no more than 2%, 1% or 0.5%. The difference between static extension in length direction and static extension in the cross direction can be no more than 1% or, preferably, no more than 0.5%.

In another embodiment of the invention, the extension of the blanket when subjected to static load of 10 Newtons per mm for a period of 10 minutes in at least one direction is no more than 0.6%. With a blanket manufactured to this specification there is possible an offset printing of particularly high resolution.

The fabric plies which may still be incorporated in the construction serve purely to improve the interply adhesion/bonding. For this reason less expensive fabric with higher stretch can be used as their stretch characteristics are of no significance.

One or more reinforcing layers made from polymeric or metallic foil have the advantage, unlike woven fabrics, of being isotropic and thus the blanket can be mounted on the blanket cylinder in length or cross direction and, if necessary, can be cut from the roll in any convenient direction. In this way, a greater number of cylinder widths can be supplied using any given roll width with a reduction in waste. Thus, for the blanket manufacturer, the number of blanket widths required is reduced, while the user is spared the necessity of stocking blanket rolls in widths corresponding to cylinder widths. Furthermore, blankets which have been damaged or contaminated in a particular area (a so-called "wrap-around" or "smash"), can, after removal of the damaged area, be re-cut in the most economical direction and reinstalled on a smaller format blanket cylinder and thus be utilized further.

The reinforcing layer made from a polymeric or metallic foil also exhibits a markedly lower stretch in absolute terms than normal state-of-the-art blankets with a reinforcing layer made from woven textile material, so that blurring or increase in dot size (dot-gain) is reduced. In this way, an improvement of the resolution achievable with the printing blanket is possible. The print artworks, which is transferred either by means of a rigid polyester foil (film) or directly to the equally rigid printing plate, is transferred, in the case of the described embodiment, by means of the similarly rigid printing blanket onto the substrate (paper, board, metal, plastic) which is also rigid. Therefore, at each step in the printing process, only a small degree of stretch takes place in the image transferring medium, in contrast to known types of printing blankets with reinforcing layers made from woven textiles.

Just as the degree of stretch exhibited by the blanket is small, so is the degree of variation in the stretch itself. This is particularly advantageous for four-colour (or multicolor) printing where the material which is to be printed is overprinted several times with different colors in order to create the finished colour printed image. The smaller the divergence of stretch between the blankets used on the four (or more) different blanket cylinders, the more precise is the disposition of the colors to one another and the better the quality of the final printed color image.

The printing blanket according to the invention has the further advantage, that since it has a low extension, a frequent retensioning is not necessary, unlike the known printing blankets. Furthermore, the gauge loss caused by stretching the printing blanket is smaller.

In addition, the blanket according to the embodiment exhibits a low plastic extension, i.e. when used on frequent occasions with intervals between each use when the blanket is removed from the press, the blanket returns to its original length (extent) and has, so to speak a "memory". This is particularly advantageous when areas are stripped out so that these areas will not print. This procedure is, as mentioned above, used in order to coat certain areas of the printed image with a layer of varnish while leaving other areas unvarnished for gluing areas etc.

When areas of a blanket are stripped out for use in varnishing applications, this involves, as mentioned, cutting, either manually or by means of a CAD machine, down to the reinforcing layer in order to create a recess in the surface deep enough to prevent the accumulation of varnish in the stripped areas. It is thus advantageous that the bond strength of the layers above the reinforcing layer, i.e. on the same side as the lithographic surface, should be less than the bond strength between the reinforcing layer 1 and the textile layer 2 beneath it. In this way, easier stripping of the cut-outs in made possible. A relatively strong bond between the textile layer 2 and the reinforcing layer 1 is also necessary in view of the need to affix the disposable bars firmly, as these are bonded or glued to the textile layer 2. It is most advantageous if the bond strength between the reinforcing layer and the layers above is of the order of 0.3–1 kg/cm, whereas the bond strength between the reinforcing layer 1 and the textile layer 2 beneath it should preferably be greater than 1 kg/cm. In this regard, it is of particular advantage to specify a target value precisely indicating the force required to separate the layers situated above the reinforcing layer 1 from that layer 1, in order to ensure easy removal of the relevant areas from the blanket for varnishing.

If the reinforcing layer 1 is a polyester foil, it is particularly helpful if the interply adhesive or undercoating, which is of course present between each of the individual layers in the blanket in order to bond them together, is manufactured from an antistatic rubber compound. Since the polyester foil is hydrophobic and dielectric and does not absorb any water, a static charge can develop therewithin it. By using antistatic rubber compounds for the interply adhesive layers, static build up in the rest of the blanket can be avoided. The prevention of static build up in the blanket is further assisted if the reinforcing layer 1 exhibits a static extension of less than 0.4%.

We claim:

1. A flat offset printing blanket produced from a severed segment of a continuous length of material, having a lithographic surface (6), at least one compressible layer (3), at least one reinforcing layer (1) with stretch characteristics wherein the stretch exhibited by the blanket along both length and cross-directions thereof does not exceed 3% and a difference in the static extension between the length and cross-directions does not exceed 1% when subjected to a static load of 10 Newtons per mm in both the length and cross directions of the blanket for a period of 10 minutes, and includes a fabric layer (2) on a side of the at least one reinforcing layer (1) which is opposite to the lithographic printing surface (6), and wherein said at least one compressible layer (3) is arranged between the lithographic surface (6) and the at least one reinforcing layer (1).

2. An offset printing blanket according to claim 1, wherein the fabric layer (2) is attached on a side of the at least one reinforcing layer (1) which is opposite to the side of the reinforcing layer which faces the lithographic surface (6).

3. An offset printing blanket according to claim 1, wherein at least one additional compressible layer is located between the lithographic surface (6) and the at least one reinforcing layer (1).

4. An offset printing blanket according to claim 1, wherein at least one additional reinforcing layer (9) is located between the fabric layer (2) and the at least one reinforcing layer (1).

5. An offset printing blanket according to claim 1, wherein said at least one reinforcing layer (1) is selectively constituted of a polymeric or metallic foil.

6. An offset printing blanket according to claim 1, wherein the difference between the static extension in the length direction and that in the cross direction is about 0.5%.

7. An offset printing blanket according to claim 1, wherein said at least one reinforcing layer (1) is made from a polyester foil.

* * * * *